United States Patent [19]

Goertz et al.

[11] Patent Number: 4,751,541

[45] Date of Patent: Jun. 14, 1988

[54] APPARATUS FOR TREATING EXPOSED PHOTOSENSITIVE MATERIALS

[75] Inventors: Viktor Goertz, Bergneustadt; Harald Hoffmann, Attendorn-Dünschede, both of Fed. Rep. of Germany

[73] Assignee: JOBO-Labortechnik GmbH. & Co. KG, Gummersbach, Fed. Rep. of Germany

[21] Appl. No.: 79,822

[22] Filed: Jul. 30, 1987

[30] Foreign Application Priority Data

Aug. 6, 1986 [DE] Fed. Rep. of Germany ..... 3626614

[51] Int. Cl.[4] ..... G03D 3/08

[52] U.S. Cl. ..... 354/299; 354/316; 354/330

[58] Field of Search ..... 354/299, 312, 313, 314, 354/315, 316, 329, 330

[56] References Cited

U.S. PATENT DOCUMENTS

| | | | |
|---|---|---|---|
| 3,623,416 | 11/1971 | Anderberg | 354/330 |
| 3,693,529 | 9/1972 | Stabler | 354/330 |
| 4,035,818 | 7/1977 | King | 354/323 |
| 4,152,066 | 5/1979 | De Boute | 354/312 |
| 4,269,501 | 5/1981 | Griffith et al. | 354/330 |
| 4,277,159 | 7/1981 | Descotes | 354/330 |
| 4,708,451 | 11/1987 | Wing et al. | 354/330 |

FOREIGN PATENT DOCUMENTS

| | | | |
|---|---|---|---|
| 1494737 | 12/1977 | United Kingdom | 354/329 |

*Primary Examiner*—A. A. Mathews

*Attorney, Agent, or Firm*—Peter K. Kontler

[57] ABSTRACT

A developing apparatus wherein a hollow drum-shaped conveyor has an internal partition with a set of tubular receptacles for exposed photosensitive material. The partition and one end wall of the conveyor define a chamber the lower portion of which contains a supply of liquid, and each receptacle has an open end in communication with the chamber. When the conveyor is set in rotary motion, the open ends of successive receptacles dip into the supply of liquid and scoop up some liquid which then flows out of the receptacles while they rise above and thereupon descend back toward the supply of liquid. Such liquid can be caused to indirectly exchange heat with water which is confined in a compartment at the other side of the partition and/or in a trough into which the lower portion of the rotating conveyor is immersed.

20 Claims, 3 Drawing Sheets

APPARATUS FOR TREATING EXPOSED PHOTOSENSITIVE MATERIALS

BACKGROUND OF THE INVENTION

The invention relates to apparatus for treating photosensitive materials with liquids, especially to improvements in developing machines for exposed photographic paper, exposed photographic films and the like. More particularly, the invention relates to improvements in developing and like apparatus of the type wherein the photosensitive materials are caused to orbit while being contacted by a liquid.

It is known to develop exposed photographic paper or exposed photographic films in a drum-shaped conveyor which is caused to rotate about a horizontal axis and repeatedly dips the photosensitive material into a developing, bleaching or fixing solution. As a rule, the supply of liquid is selected in such a way that the photosensitive material comes in contact with the liquid only during travel along the lower part of its endless path. The conveyor is a lattice- or grid-like structure which carries clamps or like retaining devices for photosensitive material. The retaining devices are designed and positioned to maintain the attached photosensitive material close to the periphery of the conveyor. When the latter is in use, its lower portion dips into a supply of liquid in a vessel and the conveyor is set in motion so that successive retaining devices advance the respective photosensitive materials into, through and out of the body of liquid during each revolution of the conveyor. When the treatment with a developing solution is completed, the conveyor is caused to dip into a supply of fixing solution, followed by a supply of bleaching medium, and so forth. Washing in water or in another cleansing fluid can follow the treatment with developing, fixing and bleaching media so that the developing solution is washed away before the thus treated photosensitive material is permitted to come into contact with the next solution, and so forth. The conveyor can be transferred from a preceding vessel into the next following vessel when a particular stage of development is completed. Alternatively, the apparatus employs a single vessel and the latter is evacuated after each stage of treatment so that it can receive the next liquid medium.

An advantage of such developing apparatus is that they can operate with relatively small quantities of liquids. This will be readily appreciated since only a single piece of photosensitive material or a very small number of pieces of photosensitive material will actually dip into the body of liquid in the adjacent vessel. However, presently known rotary developing apparatus also exhibit a number of drawbacks, especially as regards the mode of securing photosensitive material to the conveyor and the quality of the developed products. Thus, the developed material can exhibit streaks due to the establishment of currents in the body of liquid. Moreover, the individual items of photosensitive material cannot be placed too close to each other so that they would overlap during travel through a developing solution or another liquid. This reduces the output of the apparatus because the conveyor can carry only a limited number of sheets of exposed photographic paper, exposed photographic films and like photosensitive materials.

It is further known to simply dip exposed photosensitive materials (such as exposed photographic paper or exposed photographic films) into a body of liquid. The photosensitive material is placed into a basket or into a like container which is permeable to liquids, and the container is thereupon immersed into a body of liquid in a tank. This enhances the quality of development because the body of liquid in the tank is stagnant, i.e., it does not form currents which could cause streaking and like undesirable phenomena. However, such apparatus must employ large quantities of developing, fixing, bleaching and other solutions.

OBJECTS AND SUMMARY OF THE INVENTION

An object of the invention is to provide a novel and improved rotary developing apparatus wherein the photosensitive material which is to be developed is supported and acted upon by liquids in a novel and improved way.

Another object of the invention is to provide an apparatus which uses small quantities of liquids and wherein the temperature of such liquids can be influenced and maintained within a desired range in a novel and improved way.

A further object of the invention is to provide a novel and improved conveyor for use in the above outlined rotary developing apparatus.

Still another object of the invention is to provide novel and improved means for carrying photosensitive material through a body of liquid in a rotary developing apparatus.

An additional object of the invention is to provide a novel and improved method of manipulating exposed photographic films, exposed photographic paper and other photosensitive materials in a developing machine of the type wherein the photosensitive materials are caused to orbit along a predetermined path.

A further object of the invention is to provide the apparatus with novel and improved means for stabilizing the conveyor and with novel and improved means for affording access to photosensitive materials in the conveyor.

The improved apparatus serves to contact exposed photosensitive materials with a liquid (e.g., with a developing, fixing or bleaching solution or with a rinsing fluid) and comprises a hollow substantially drum-shaped conveyor which is rotatable about a substantially horizontal axis and includes a tubular section (e.g., a relatively short hollow horizontal cylinder) having an end portion. The conveyor also comprises a preferably hollow frustoconical end wall or closure at the end portion of the tubular section. The apparatus further comprises a partition which is installed in and can form an integral part of the conveyor and extends transversely of the axis of rotation of the conveyor. The end wall and the partition define a chamber having a lower portion which can contain a supply of liquid, and the partition further comprises a plurality of receptacles with open ends which communicate with the chamber and serve to receive photosensitive material. The open ends of successive receptacles dip into the supply of liquid in the lower portion of the chamber in response to rotation of the conveyor about its axis.

The receptacles are or can be substantially parallel to the axis of rotation of the conveyor and extend in a direction away from the end wall. Each receptacle can constitute, resemble or include a tube, and the receptacles can form an annulus (particularly a circular array) about the axis of rotation of the conveyor. For example, each receptacle can include a hollow barrel to thus reduce the area of contact between an inserted photosensitive material and the internal surface of the respective receptacle. At least one of the receptacles can have protuberances which project from its internal surface to maintain the inserted photosensitive material out of any contact or in negligible or non-pronounced contact with such internal surface, and each protuberance can constitute or include a flat, e.g., each protuberance can resemble a tooth with a top land in the form of a flat.

Each receptacle can include a closed end portion or bottom wall which is remote from the respective open end, and the apparatus can comprise a common support (e.g., in the form of a ring) for the closed end portions of the receptacles.

The conveyor can include a second wall which is remote from the aforementioned end portion and from the end wall. The partition is disposed between the two walls and defines with the second wall a compartment for a supply of heat exchange medium (e.g., water) which can be introduced into the compartment and/or maintained in the compartment at a predetermined temperature and serves to exchange heat with the liquid in the chamber through the medium of the partition. The second wall can constitute an end wall which is permanently or separably secured to the other end portion of the tubular section. The second end wall can be provided with at least one aperture which is adjacent the respective end portion of the tublar section to allow for admission or evacuation of the heat exchange medium. Each such aperture can be formed by a marginal recess of the second end wall and by the adjacent part of the respective end portion of the tubular section. The inner side of the second end wall is preferably substantially concave so that it can gather remnants of the heat exchange medium when the conveyor is placed on end so that the second end wall is located at a level below the tubular section.

The liquid in the chamber can further exchange heat with a supply of a heat exchange medium in a vessel into which the lower portion of the conveyor extends. Such vessel can constitute a trough or tank having an open top, and the heat exchange medium in the vessel exchanges heat with the liquid in the chamber by way of the frustoconical end wall and/or by way of the tubular section of the conveyor.

The frustoconical end wall preferably tapers in a direction axially of the conveyor and away from the partition. Such end wall can have an end portion adjacent the respective end portion of the tubular section, and one of these end portions can be sealingly telescoped into or otherwise received in the other end portion. The frustoconical end wall can have a substantially centrally located opening for admission of liquid into and for evacuation of liquid from the chamber. A light barrier can be installed in the chamber between the opening and the partition. The light barrier and the frustoconical end wall preferably define a labyrinthine path for the flow of liquid between the interior of the conveyor and the opening in response to tilting of the conveyor. The light barrier and the opening can be installed at a level above the supply of liquid in the lower portion of the chamber when the apparatus is in use.

The means for rotating the conveyor can include a gear or another suitable torque transmitting element on the frustoconical end wall or on the other end wall of the conveyor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
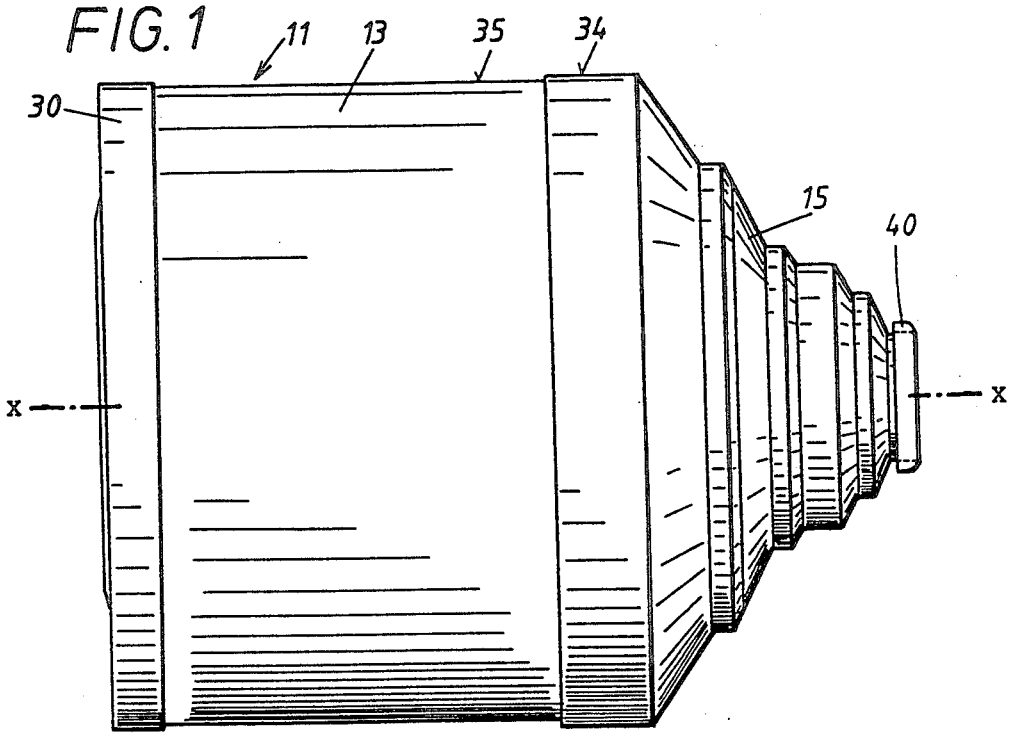
FIG. 1 is an elevational view of the hollow drum-shaped conveyor in an apparatus which embodies the invention.

The apparatus which is shown in the drawing serves to contact exposed photosensitive materials 10 (such as exposed photographic paper or exposed photographic customer films) with a liquid 12. The apparatus comprises a hollow rotary drum-shaped conveyor 11 and a specially designed partition 16 in the interior of the conveyor. The latter is rotatable about a substantially horizontal axis X—X and includes a tubular (preferably cylindrical) section 13, a first end wall or closure 15 which is adjacent the right-hand end portion 35 of the tubular section 13 (as viewed in FIG. 2), and a second end wall 25 adjacent the other end portion 30 of the section 11. The liquid 12 fills the lower portion of a chamber 18 which is defined by the partition 16 and by the closure 15. Such liquid can constitute a developing, fixing or bleaching solution, a rinsing agent (e.g., water) or any other liquid substance which is to contact the photosensitive material 10 during treatment of such material following its exposure to radiation. The partition 16 extends transversely of the axis X—X and includes six equidistant hollow barrel-shaped tubular receptacles 17 each of which can receive and transport a single piece of photosensitive material 10 or two or more pieces. When the conveyor 11 is driven to rotate about its axis, the open right-hand ends of successive receptacles 17 dip into the supply of liquid 12 in the lower portion of the chamber 18, and each such receptacle entrains from the supply a certain quantity of liquid which thereupon flows out of the receptacle by way of the respective open end to descend back into the lower portion of the chamber 18. The closure 15 is a hollow conical frustum and has a centrally located opening 14 which serves for admission of liquid 12 into and for evacuation of liquid from the chamber 18.

The partition 16 is spaced apart from the closure 15 as well as from the end wall 25, and its receptacles 17 preferably extend in substantial parallelism with the axis X—X. The conveyor 11 which is shown in the drawing has six equidistant receptacles 17 each of which is a slightly barrel-shaped tube having an open end facing the closure 15 and communicating with the chamber 18 and a closed end portion (bottom wall 26) which is adjacent to but spaced apart from the end wall 25. The quantity of liquid 12 in the lower portion of the chamber 18 can be selected in such a way that the receptacle 17 which is located at the six o'clock position of the conveyor 11 is fully or nearly fully immersed in the liquid (see FIGS. 2 and 3). As mentioned above, the receptacles 17 scoop liquid 12 from the lower portion of the chamber 18 and the scooped up liquid thereupon leaves the rising and subsequently descending receptacles at a rate such that the evacuation of the lifted body of liquid 12 from a receptacle is or can be completed or nearly completed when the respective receptacle again reaches the lower portion of the chamber 18 so that the photosensitive material 10 in the receptacles 17 is in continuous contact with the liquid 12 as long as the conveyor 11 is driven to rotate about the axis X—X. This ensures predictable and uniform treatment of all photosensitive materials 10 in the respective receptacles 17. In addition, the liquid 12 is thoroughly mixed whenever and as long as the conveyor 11 is driven.

Figure 4:
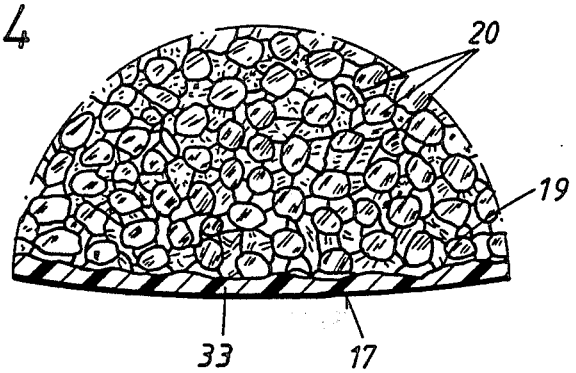
FIG. 4 is an enlarged view of a detail within the phantom-line circle IV in FIG. 2.

An advantage of the improved apparatus is that a reasonably large number of pieces or items of photosensitive material 10 can be treated with a very small quantity of liquid. This is important when the liquid is expensive, e.g., if such liquid is a developing, bleaching or fixing solution. The utilization of tubular receptacles 17 which resemble hollow barrels also contributes to the establishment of contact between the liquid and each portion of the material 10 in a receptacle because the internal surfaces 19 of the hollow barrel-shaped receptacles are in mere linear contact with rolled up photographic films, rolled up photographic papers or like sheet- or strip-shaped photosensitive materials. The arrangement may be such that the external surface of each receptacle 17 can constitute a true cylinder or can have any other desired shape, as long as the internal surfaces 19 are barrel-shaped, i.e., as long as their diameters increase in directions from the respective open ends as well as in directions from the respective bottom walls 26 to reach their maximum values somewhere in or close to the middle (as seen in the axial direction of the tubular section 13). When a sheet of exposed photographic paper or a strip of exposed photographic film is inserted in a receptacle 17 in rolled up condition, its outermost convolution is normally in a mere twin linear contact with the internal surface 19 of the respective receptacle. Thus, the liquid 12 can flow along the internal surfaces 19 to contact the major part of or the entire external surface of the outermost convolution. The internal surfaces 19 of some or all of the receptacles 17 can be provided with protuberances 20, e.g., in the form shown in FIG. 4 and exhibiting a waffle-like or honeycomb pattern. Each protuberance 20 can have one or more flats at its top. The protuberances 20 even further reduce the likelihood of extensive contact between the photosensitive material 10 and the internal surfaces 19 of the respective receptacles 17.

Figure 5:
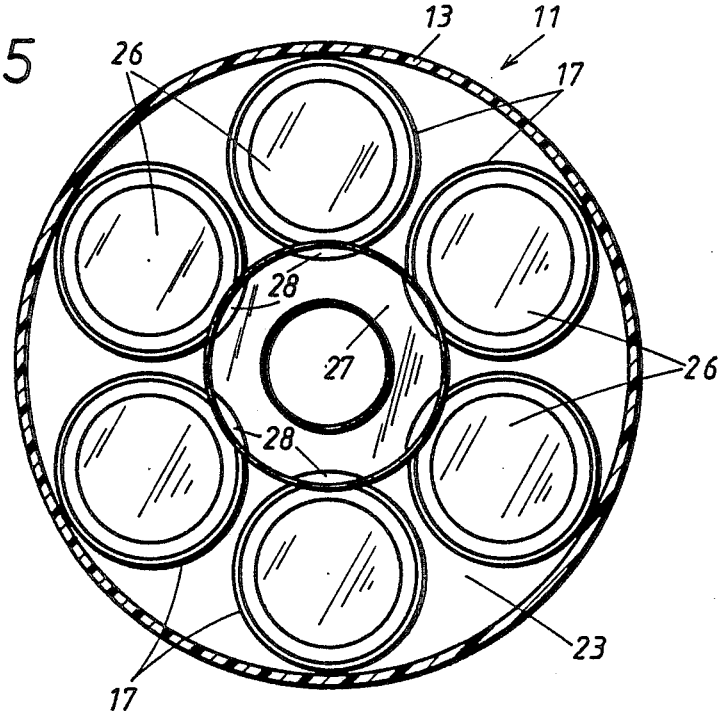
FIG. 5 is a transverse vertical sectional view as seen in the direction of arrows from the line V—V of FIG. 2.

The apparatus preferably further comprises means for supporting and bracing the closed end portions including the bottom walls 26 of the receptacles 17. The illustrated supporting and bracing means includes a ring 27 which has sockets 28 (FIG. 5) for the respective end portions of the receptacles 17 and which reduces the likelihood of deformation of the receptacles. Receptacles 17 with relatively thin walls 33 are desirable and advantageous if the temperature of the liquid 12 is to be maintained at a given value or within a rather narrow range by means of one or more liquid media which are called upon to exchange heat with the liquid 12 in the receptacles. The stability of the assembly including the bottom end walls 26 of the receptacles 17 and the supporting ring 27 suffices to ensure that the integrity of the receptacles is not affected when the conveyor 11 is caused to rotate at a relatively high speed and/or under the action of gravity when the receptacles scoop up liquid 12 from the lower portion of the chamber 18 and lift such liquid while travelling from the lower portion toward the top and then back to the lower portion of the chamber. The ring 27 can have a substantially U-shaped cross-sectional outline, and the aforementioned sockets 28 can be provided in its outer leg. Such ring can be bonded or otherwise secured to the adjacent end portions of the receptacles 17.

The partition 16 and the end wall 25 define a compartment 23 which can serve for reception of a supply of liquid heat exchange medium 21. Such medium can be introduced into the compartment 23 at a predetermined temperature and/or can be maintained at such temperature subsequent to admission into the compartment. As mentioned above, the medium 21 can exchange heat with the liquid 12 in the chamber 18 and in the receptacles 17 through the thin-walled partition 16. The heat exchange medium 21 can be water and it can further fill a portion at least of a trough-shaped or tank-shaped vessel 22 (see FIG. 3) having an open top to enable the conveyor 11 to dip into the supply of liquid heat exchange medium 21 therein. Such medium exchanges heat with the liquid 12 through the closure 15 and also through a portion of the tubular section 13. The vessel 22 can receive a supply of heat exchange medium 21 at a given temperature or it can be provided with means for monitoring the temperature of the medium 21 therein and for controlling a heater (not shown) which serves to raise the temperature of the medium if and when necessary.

Figure 2:
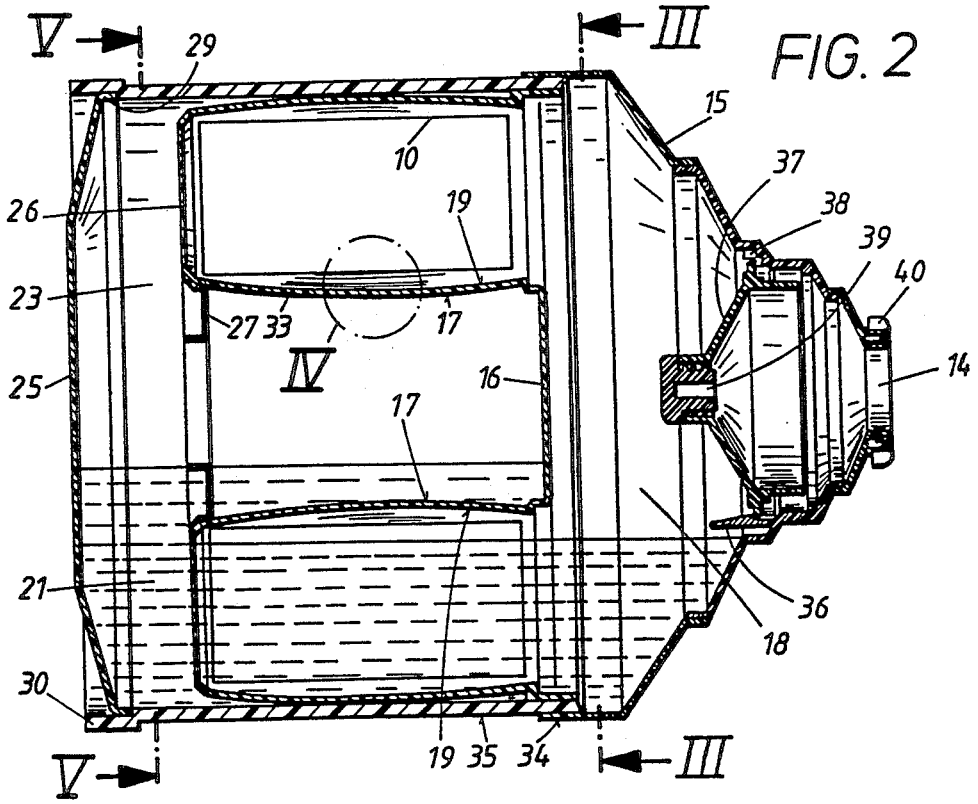
FIG. 2 is a vertical axial sectional view of the conveyor, further showing the partition and the supply of liquid in the chamber.
Figure 3:
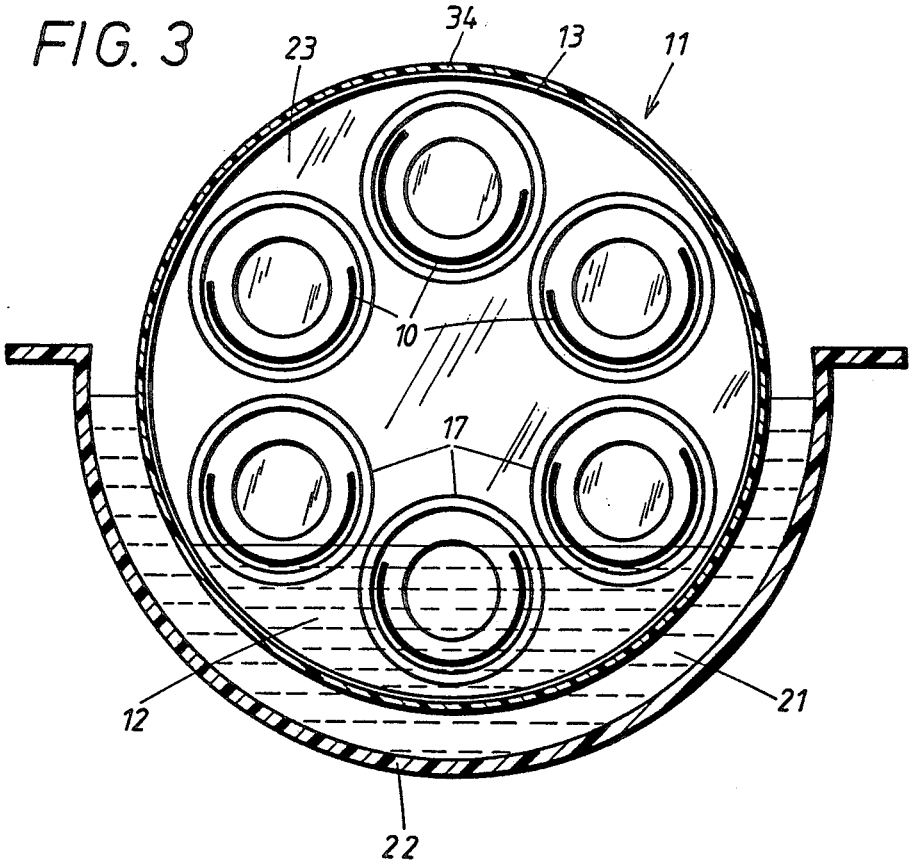
FIG. 3 is a transverse vertical sectional view as seen in the direction of arrows from the line III—III in FIG. 2, further showing a troughshaped vessel for a supply of liquid heat exchange medium which contacts the lower half of the conveyor.
Figure 6:
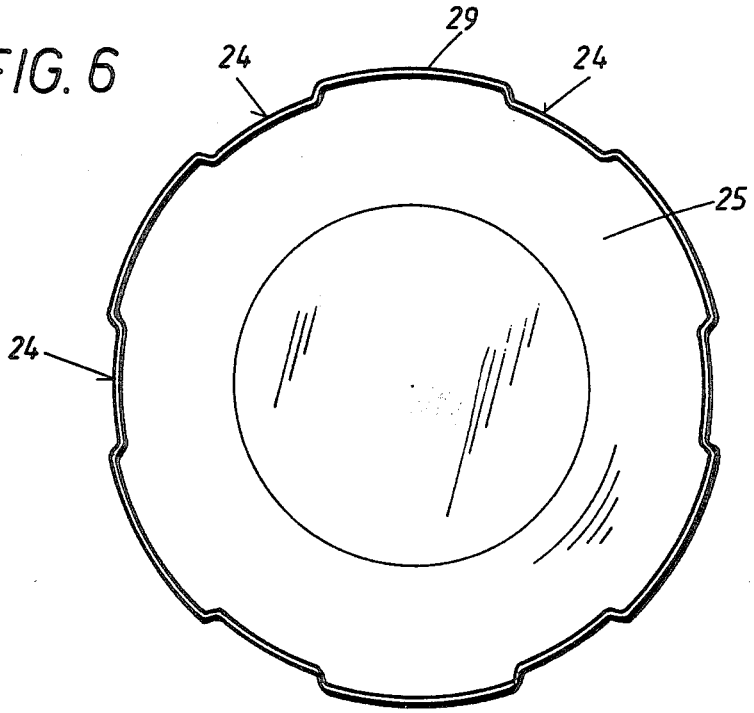
FIG. 6 shows the inner side of the left-hand end wall of the conveyor of FIG. 2.

The compartment 23 between the end wall 25 and the partition 16 communicates with the interior of the vessel 22 by way of several apertures 24 which are actually notches or recesses in the marginal portion of the end wall 25 (see FIG. 6). The marginal portion of the end wall 25 has a cylindrical extension 29 which is sealingly received in the enlarged end portion 30 at the respective axial end of the tubular section 13. The extension 29 can be simply a tight fit in the end portion 30 but it is also possible to establish a more or less permanent connection between the section 13 and the end wall 25. The inner side of the end wall 25 is concave or substantially concave, i.e., its central portion extends axially to the left (as seen in FIG. 2) beyond the apertures 24 so as to ensure that the end wall 25 will serve as a cup for remnants of liquid heat exchange medium 21 which leaves the compartment 23 when the conveyor 11 is placed on end so that the end wall 25 is disposed at a level below the tubular section 13. Remnants of the heat exchange medium 21 which has left the compartment 23 via apertures 24 then gather in the central portion at the concave inner side of the end wall 25. The number of apertures 24 can be reduced below or increased above six.

The placing of apertures 24 close to the end portion 30 of the tubular section 13 is desirable and advantageous because the major part of the end wall 25 is devoid of apertures and thus serves as a heat barrier to prevent rapid cooling of the adjacent portions of the receptacles 17 as a result of evaporation of moisture from the left-hand surface of the partition 16.

The supply of heat exchange medium 21 in the compartment 23 is separated from the body of liquid 12 in the lower portion of the chamber 18 only by the thin or very thin walls 33 of the receptacles 17 and by the equally thin remaining upright portion of the partition 16. The heat exchange medium 21 in the compartment 23 and/or in the vessel 22 first serves as a means for rapidly heating the initially cool conveyor 11 and thereupon as a means for maintaining the temperature of the liquid 12 at or close to a predetermined level. The arrangement may be such that the temperature of the heat exchange medium 21 matches the preferred or optimum temperature of the liquid 12, and the medium 21 is thereupon maintained at such temperature.

The apparatus can be furnished or provided with a pump for evacuation of liquid 12 from the chamber 18. Such pump can be used in addition to or in lieu of the central opening 14 in the hollow frustoconical closure 15. All that is necessary is to place the conveyor 11 on end so that the closure 15 is located at a level below the tubular section 13 whereby the liquid 12 is free to leave the chamber 18 by way of the opening 14. If a fresh supply of liquid 12 (or another liquid) is to be admitted into the chamber 18, the conveyor 11 is set up in a position such that the closure 15 is located at a level above the tubular section 13.

The left-hand end portion 34 of the closure 15 (as seen in FIG. 2) is a short cylinder which is telescoped onto (as shown) or into the adjacent end portion 35 of the tubular section 13 to establish a fluidtight seal which prevents leakage of liquid 12 from the chamber 18. The illustrated closure 15 is stepped (it includes several cylindrical portions alternating with frustoconical portions) and its opening 14 is located at a level above the supply of liquid 12 when the conveyor 11 is held in a position for rotation about the horizontal axis X—X. A hollow frustoconical closure 15 is preferred at this time because it renders it possible to form a relatively large chamber 18 whose lower portion can accommodate a requisite quantity of liquid 12 so as to ensure an optimum treatment of photosensitive material 10 in successive receptacles 17 of the partition 16 when the conveyor 11 is driven by a pinion (not shown), driven by a motor (not shown), through the medium of a torque transmitting element 40 (e.g., a gear or toothed pulley) surrounding the opening 14. It is equally possible to provide torque transmitting means on the tubular section 13, on the end wall 25 or on another portion of the closure 15. The provision of a relatively large chamber 18 is preferred at this time in order to ensure that the liquid which is scooped up by successive receptalces 17 can readily flow back into the lower portion of the chamber and that an adequate quantity of liquid 12 remains in the lower portion of the chamber to be scooped up by successive receptacles 17 of the rotating partition 16.

The closure 15 contains holder means 36 (e.g., a bayonet mount or another quick-release coupling) for a labyrinth type funnel-shaped light barrier 37 which is located at a level above the supply of liquid 12 in the chamber 18 and is disposed in front of the opening 14. The holders 36 and the light barrier 37 define passages or paths 38 for the flow of liquid 12 into the opening 14 in response to appropriate tilting of the conveyor 11. Admission of fresh liquid into the chamber 18 can take place through a central opening of the funnel-shaped light barrier 37; this opening is sealed by a plug 39 when the apparatus is in actual use.

The parts 13, 15 and 25 of the conveyor 11 can be made of a suitable plastic material which can stand the corrosive and/or other influences of the liquid 12 in the chamber 18. The partition 16 can also consist of or contain a plastic material; in fact, this partition can constitute an integral part of the conveyor 11. Alternatively, at least the partition 16 can be mass-produced as a separate part which is thereupon glued, welded or otherwise secured to the adjacent part of the conveyor 11. It is also possible to produce the disc-shaped portion of the partition 16 separately from the receptacles 17 and to thereupon weld, adhesively secure or otherwise reliably and sealingly connect the separately produced receptacles to the disc-shaped portion of the partition.

An important advantage of the improved apparatus is that it can operate satisfactorily with surprisingly small quantities of liquid in the chamber 18. This is due to the fact that the developing solution and/or other liquids which are to come in contact with the photosensitive material 10 are confined in the conveyor 11 rather than in a vessel into which the lower portion of the conveyor must dip as in many conventional rotary developing apparatus. The majority of receptacles 17 are at least nearly empty (as far as the liquid 12 is concerned), even though they can continuously retain a thin film of liquid 12 along their internal surfaces 19 whenever and as long as the conveyor 11 is driven. Moreover, and since each of the receptacles 17 acts not unlike a scoop which lifts a certain amount of liquid 12 while beginning to move from the six o'clock position toward the twelve o'clock position, the liquid 12 is subjected to a desirable and thorough mixing action so that each and every part thereof exhibits the same properties. This contributes to a more satisfactory development of photosensitive material.

The illustrated distribution of receptacles 17 in the form of a circle around the axis X—X of rotation of the conveyor 11 has been found to be quite satisfactory because a relatively large number of receptacles can be accommodated in a small area and the apparatus can employ a relatively small conveyor (i.e., a conveyor having a relatively small diameter).

The outlay for proper tempering of the liquid 12 will depend on the nature of photosensitive material 10 and on the desired quality of the developed material. As a rule, the liquid 12 is introduced in preheated condition and the purpose of the heat exchange medium 21 in the compartment 23 and/or in the vessel 22 is to ensure that the temperature of the introduced liquid 12 will remain unchanged or will deviate only slightly from the desired value. In addition, and as mentioned above, the heat exchange medium 21 can serve to rapidly raise the temperature of the initially cool conveyor 11. The exchange of heat between the liquid 12 and the heat exchange medium 21 in the compartment 23 and/or in the vessel 22 can be promoted by reducing the thickness of the closure 15 and partition 16 as well as by appropriate selection of the material of the partition and closure. The vessel 22 constitutes or can constitute the sole source of heat exchange medium 21 because the apertures 24 enable such medium to flow between the interior of the vessel and the compartment 23 when the apparatus is in actual use. This simplifies the task of maintaining the temperature of the heat exchange medium at a desired value or within a desired range.

The closure 15 will be separated from the tubular section 13 to allow for removal of treated photosensitive materials 10 from the receptacles 17 as well as to allow for introduction of fresh (exposed but still undeveloped) photosensitive materials.

The improved apparatus is susceptible of many additional modifications without departing from the spirit of the invention. For example, the number of receptacles 17 can be increased above or reduced to less than six. Moreover, the receptacles 17 can include larger and smaller receptacles or differently configurated receptacles, depending on the nature and on the dimensions of photosensitive material which is to be temporarily confined therein.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for contacting exposed photosensitive materials with a liquid, comprising a substantially drum-shaped hollow conveyor rotatable about a substantially horizontal axis and including a tubular section having an end portion and an end wall at said end portion; and a partition in said conveyor, said partition extending transversely of said axis and defining with said end wall a chamber having a lower portion for a supply of liquid, said partition including a plurality of receptacles having open ends communicating with said chamber and arranged to receive photosensitive material and to dip their open ends seriatim into the supply of liquid in the lower portion of said chamber in response to rotation of said conveyor about said axis.

2. The apparatus of claim 1, wherein said receptacles are substantially parallel to said axis and extend in a direction away from said end wall.

3. The apparatus of claim 1, wherein said receptacles include tubes.

4. The apparatus of claim 1, wherein said receptacles form an annulus about said axis.

5. The apparatus of claim 1, wherein at least one of said receptacles includes a hollow barrel.

6. The apparatus of claim 1, wherein at least one of said receptacles has an internal surface and protuberances extending beyond said internal surface to maintain the photosensitive material in the one receptacle out of any or out of pronounced contact with said internal surface.

7. The apparatus of claim 6, wherein said protuberances have flats.

8. The apparatus of claim 1, wherein said receptacles include closed end portions remote from said open ends and further comprising a common support for said closed end portions.

9. The apparatus of claim 8, wherein said common support includes a ring.

10. The apparatus of claim 1, further comprising a vessel for a supply of liquid heat exchange medium, said conveyor dipping into said supply of heat exchange medium so that the latter can exchange heat with the liquid in the lower portion of said chamber, at least by way of said end wall.

11. The apparatus of claim 10, wherein said vessel includes a trough having an open top.

12. The apparatus of claim 1, wherein said conveyor further comprises a second wall remote from said end portion, said partition being disposed between said walls and defining with said second wall a compartment for a supply of liquid heat exchange medium, such medium exchanging heat with the liquid in said chamber by way of said partition.

13. The apparatus of claim 12, wherein said tubular section includes a second end portion and said second wall includes a second end wall engaging the second end portion of said section.

14. The apparatus of claim 13, wherein said second end wall has at least one aperture adjacent the second end portion of said tubular section.

15. The apparatus of claim 14, wherein said second end wall has a substantially concave inner side facing said partition.

16. The apparatus of claim 1, wherein said end wall has a hollow frustoconical shape and tapers in a direction away from said end portion, said end wall having an end portion adjacent the end portion of said tubular section and one of said end portions being sealingly telescoped into the other of said end portions.

17. The apparatus of claim 1, wherein 2 said end wall has an opening for admission of liquid into and for evacuation of liquid from said chamber, and further comprising a light barrier disposed in said chamber between said opening and said partition and defining with said end wall a labyrinthine path for the flow of liquid between said chamber and said opening in response to tilting of said conveyor.

18. The apparatus of claim 17, wherein said opening and said light barrier are disposed at a level above the supply of liquid in the lower portion of said chamber.

19. The apparatus of claim 1, further comprising means for rotating said conveyor, including torque transmitting means provided on said end wall.

20. The apparatus of claim 1, wherein said tubular section includes a cylinder.

* * * * *